United States Patent [19]

Robillard

[11] Patent Number: 4,672,990

[45] Date of Patent: Jun. 16, 1987

[54] SYSTEM FOR FREEZE PROTECTION OF PIPES

[76] Inventor: Fred W. Robillard, 16706 Planchett Rd., Greenwell Springs, La. 70739

[21] Appl. No.: 786,671

[22] Filed: Oct. 11, 1985

[51] Int. Cl.[4] ..... E03B 7/12; F16L 53/00

[52] U.S. Cl. ..... 137/59; 126/420; 137/337; 137/564; 137/565; 138/32; 237/80; 417/32

[58] Field of Search ..... 137/59, 337, 340, 563, 137/564, 565; 138/32; 126/420; 237/80; 417/32

[56] References Cited

U.S. PATENT DOCUMENTS

| | | | |
|---|---|---|---|
| 1,205,703 | 11/1916 | Bowman | 237/80 |
| 2,220,078 | 11/1940 | Cornell, Jr. | 137/564 |
| 2,255,460 | 9/1941 | Weaver | 137/564 |
| 2,842,155 | 7/1958 | Peters | 137/337 |
| 2,915,080 | 12/1959 | Holmes | 137/564 |
| 3,103,946 | 9/1963 | Troxell | 137/337 |
| 3,776,261 | 12/1973 | Houghton | 137/337 |
| 3,799,181 | 3/1974 | Maddren | 137/337 |
| 3,929,153 | 12/1975 | Hasty | 137/564 |
| 3,986,489 | 10/1976 | Schlesinger | 126/270 |
| 4,286,613 | 9/1981 | Lacoste | 137/62 |
| 4,321,943 | 3/1982 | Haws | 137/337 |
| 4,457,326 | 7/1984 | Donnelly | 137/564 |
| 4,471,907 | 9/1984 | Gerstmann | 237/65 |
| 4,481,966 | 11/1984 | Anderson | 137/59 |

*Primary Examiner*—George L. Walton

*Attorney, Agent, or Firm*—Robert C. Tucker; William David Kiesel

[57] ABSTRACT

A system for freeze protection of pipes is provided, comprising a cold water supply line, connected to a main water supply line at one end and to at least one cold water fixture at the other end; a hot water tank having an inlet and an outlet; a hot water tank inlet line, connected at one end to the cold water supply line, and at the other end to the hot water tank inlet; a hot water supply line, connected to the hot water tank outlet at one end and to at least one hot water fixture at the other end; at least one restrictive connection, connecting between the cold water supply line and the hot water supply line; and a circulating pump, connected in-line in a circuit comprising the cold water supply line, the hot water tank inlet line, the hot water tank, the hot water supply line and the restrictive connection.

6 Claims, 2 Drawing Figures

SYSTEM FOR FREEZE PROTECTION OF PIPES

BACKGROUND OF THE INVENTION

1. Field of the Invention

This invention relates generally to devices which prevent water in pipes from freezing and, more particularly, to such devices which accomplish freeze protection by a constant flow of water through the pipes.

2. Prior Art

The freezing of pipes in houses and other structures has historically proven to be a significant problem. In most cases, freezing of water pipes and the resulting bursting and leaking occurs in walls and attics, where pipes are exposed to temperatures near or equal to those outside. During hours of occupancy, radiant heat from the interior of the structure will often provide enough warmth to prevent most pipes from freezing. However, during periods of vacancy as well as prolonged periods of cold, interior pipes as well as those located in the extremities of the structure will be subject to freezing.

Various means have been utilized to circumvent the problem. The most common are the application of direct heat and maintenance of constant flow. Direct heat is often applied by simply maintaining interior temperatures at a level which will assure the adequate radiation of heat to all water pipes. Aside from being a tremendous waste of energy, this method often practically does not reach pipes in remote areas of the structure, such as exterior hose connections, storage rooms, garages, etc. Direct heat is also applied using heating coils, heat tape and other devices which heat pipes by direct contact. These devices also consume large amounts of energy as well as require direct access to all pipes which must be heated. Such devices also can have the disadvantage of heating cold water lines to a temperature whereby any cold water which remains static for a period of time will become overheated, which can be a safety hazard as well as an annoyance.

The most common method of maintaining constant flow is simply to allow water to drip from faucets. Of course, this process not only wastes water, but results in dangerously low water main pressure when many faucets are allowed to drip. Also, in areas exposed to prolonged, extreme cold, water may freeze in the pipes despite dripping. In order to provide any meaningful protection in such an instance, some direct heat must be applied.

Therefore, in order to adequately solve the principal problems associated with the freezing of water pipes, heat in some form should be transmitted to the water in the pipes. Prior art methods and devices require relatively large amounts of energy consumption to achieve this goal. The result has been, in most instances, to simply live with the risk of water damage from broken pipes. No devices are currently available which address all of the above problems in an economical, energy efficient manner.

SUMMARY OF THE INVENTION

Therefore, it is an object of this invention to provide a system for freeze protection of pipes whereby all pipes and fixtures in a structure which are prone to freeze may be protected.

It is also an object of this invention to provide such a system which does not require direct access to all such piping and fixtures.

It is another object of this invention to provide such a system which is adaptable to both existing and new structures.

It is still another object of this invention to provide such a system that will minimize overheating of cold water lines.

It is a further object of this invention to provide such a system which will operate for a period of time during a power failure.

It is still a further object of this invention to provide such a system which consumes a minimum amount of energy and is inexpensive to install.

Accordingly, a system for freeze protection of pipes is provided, comprising a cold water supply line, connected to a main water supply line at one end and to at least one cold water fixture at the other end; a hot water tank having an inlet and an outlet; a hot water tank inlet line, connected at one end to the cold water supply line, and at the other end to the hot water tank inlet; a hot water supply line, connected to the hot water tank outlet at one end and to at least one hot water fixture at the other end; at least one restrictive connection, conecting between the cold water supply line and the hot water supply line; and a circulating pump, connected in-line in a circuit comprising cold water supply line, the hot water tank inlet line, the hot water tank, the hot water supply line and the restrictive connection.

DESCRIPTION OF PREFERRED EMBODIMENTS OF THE INVENTION

Figure 1:
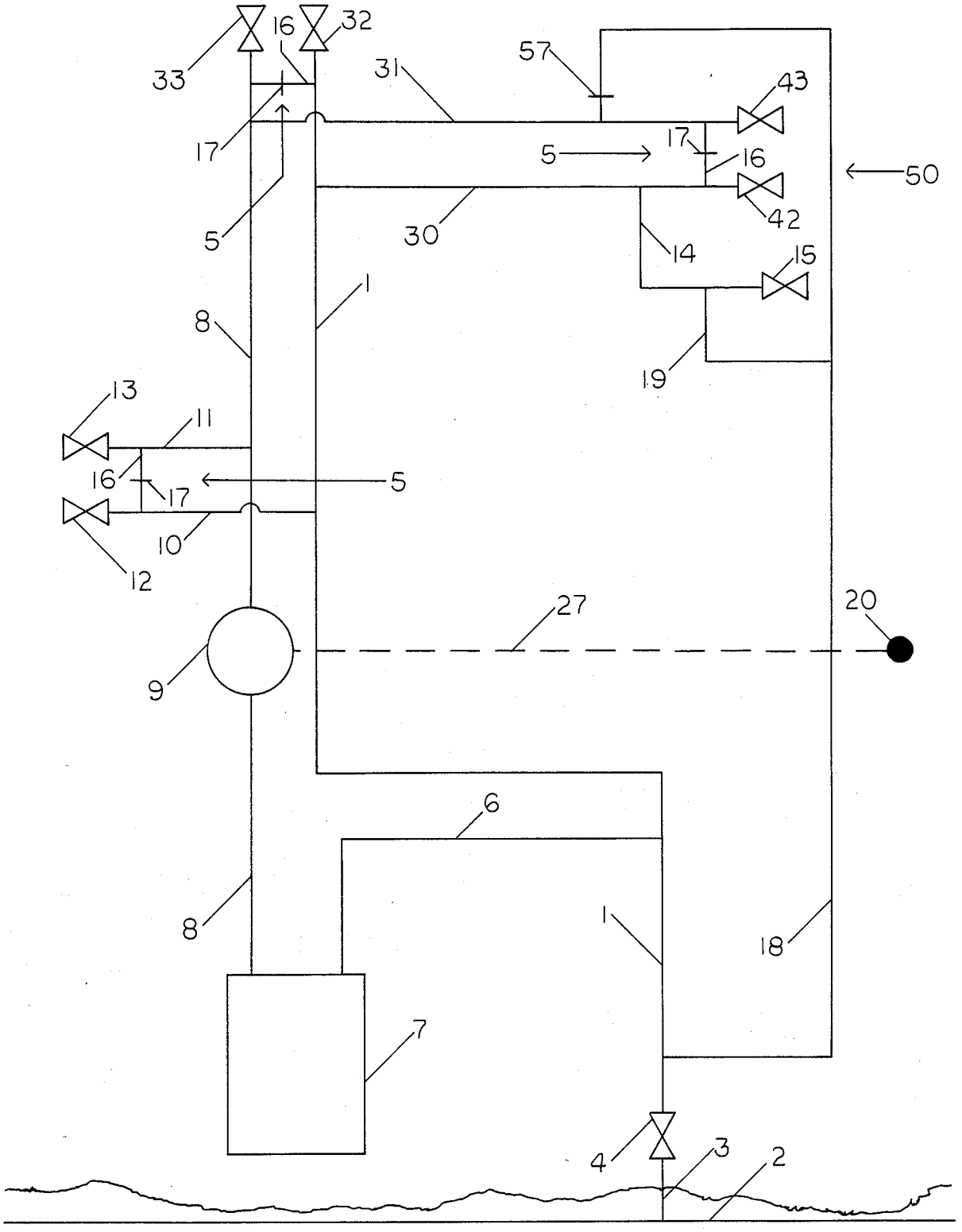
FIG. 1 is a diagrammatic illustration of an embodiment of the freeze protection system of this invention.

FIG. 1 depicts a simplified version of the invention. In a typical water system for a building or other structure, water is supplied through a cold water supply line 1 connected to a main water supply line 2, usually an underground water main, via main branch 3 and main valve 4. In most cases, it is highly unlikely that water in the main water supply line 2 would ever freeze due to warmer underground temperatures and nearly constant flow. Despite colder above-ground ambient temperatures, radiant heat from main water supply line 2 should prevent freezing of main branch line 3 and main valve 4. Cold water supply line 1 supplies cold water fixtures 12,32,42. As a matter of illustration, cold water fixture 32 is shown connected directly to cold water supply line 1, while cold water fixtures 12 and 42 are shown connected to cold water supply line 1 via cold water branch lines 10 and 30, respectively. Of course, a water system for a particular structure may comprise any number of cold water branch lines 10,30. There may even be secondary branch lines, such as the one illustrated at 14, which also terminates at a cold water fixture 15. For purposes of this application, secondary branch lines as well as any other branch lines will all hereafter be considered under the general term "branch lines". For example, cold water fixture 15 is supplied by a cold water branch line comprising part of branch line 30 and secondary cold water branch line 14. Additional branch lines could branch off of line 14, etc. Fixture 15 is shown as an example of a single fixture, such as a hose bib, as opposed to a pair comprising one cold water fixture 12,32,42 and one hot water fixture 13,33,43.

Cold water supply line 1 also supplies a typical hot water tank 7 via hot water tank inlet line 6. Hot water is supplied to hot water fixtures 13,33,43 via hot water supply line 8 and hot water branch lines 11,31 in the same manner as described above.

As fixtures at the end of a particular line begin to cool from non-use, exposure, or both, it is necessary that sufficient heat be restored to the particular line before freezing results. However, it is only necessary that a small amount of heat be added to maintain a temperature above freezing. This is accomplished by circulating a relatively small flow of hot water from the hot water lines 8,11,31 through the cold water lines 1,10,30,14. Flow is maintained by a small pump 9, placed in the piping circuit. Restrictive connections 5,50 allow warm water from the hot water lines 8,11,31 to circulate slowly through cold water lines 1,10,30,14. Since only a small flow is necessary to maintain a temperature above freezing, restrictive connections 5,50 preferably comprise tubing 16,18,19 of a size ($\frac{1}{4}$" to $\frac{3}{8}$" internal diameter) much smaller than the various hot and cold water lines (usually $\frac{1}{2}$" to $\frac{3}{4}$" internal diameter), containing an orifice 17,57 (preferably 1/16" to $\frac{1}{8}$" diameter). In order to prevent clogging, it is preferable that filter screens (not shown) be positioned on either side of each orifice 17,57 such that reversals in the direction of flow will keep them clean. The reduced size of restrictive connections 5,50 minimizes overheating of cold water lines 1,10,30,14. The small flow also places only a small energy demand on hot water tank 7. Pump 9 only need run during times of subfreezing temperatures. During normal operation of hot and cold water lines (pump 9 not running), the reduced size of restrictive connections 5,50 prevents noticeable migration of water between hot and cold water lines.

Where a pair of fixtures exists, such as those shown at 32,33, restrictive connection 5,50 may be made by simply connecting between the hot and cold water lines leading to the fixtures. In most cases there is relatively easy access to these lines just prior to the connection of the fixtures (e.g. under sinks or lavatories). A restrictive connection 5,50 should be positioned as near as possible to the end of a particular line in order to assure adequate radiation of heat to the end of the line. In the case of a single fixture (hot or cold) such as cold water fixture 15, it may be necessary for restrictive connection 50 to be of a greater length in order to connect to the nearest line of a different temperature. The same is true for any length of hot or cold water line which is not otherwise included in the circulation circuit. An example of such a situation is shown in cold water supply line 1 just above main valve 4. Thus, as shown in the Figures, one restrictive connection 50 would comprise reduced size tubing 18,19 connecting cold water supply line 1 and cold water branch line 14 to hot water branch line 31, with an orifice 57 positioned between the juncture of lines 18 and 19 and the connection to line 31. At any rate, enough restrictive connections 5,50 should be provided so as to assure circulation in a maximum portion of the piping in the structure when pump 9 is in operation.

Pump 9 may be actuated by a standard switch, such as a wall switch. In order to assure actuation, it is preferable that pump 9 be actuated by a thermostat 20 exposed to outside temperatures and connected to pump 9 by circuitry 27. Because of the small flow and pressure differential (usually no more that 5 psi), the pump 9 may be very small. Typical pump sizes should range from 1/100 hp to 1/25 hp with flow rates of less than 5 gallons per minute. In most instances, such a pump would draw less than 1 amp/hr. Pump 9 should permit free flow therethrough when not in operation in order to allow normal operation of the hot and cold water lines. It is preferable that pump 9 be provided with a magnetic drive so that it is not damaged by operation of various fixtures or reverse flow (see embodiment shown in FIG. 2) during times of pump operation. A typical acceptable pump is a Teel Model IP760 circulating pump (1/100 hp @ 1500 rpm). Pump 9 may be battery operated or may be provided with a rechargeable battery backup for operation during power outages.

Figure 2:
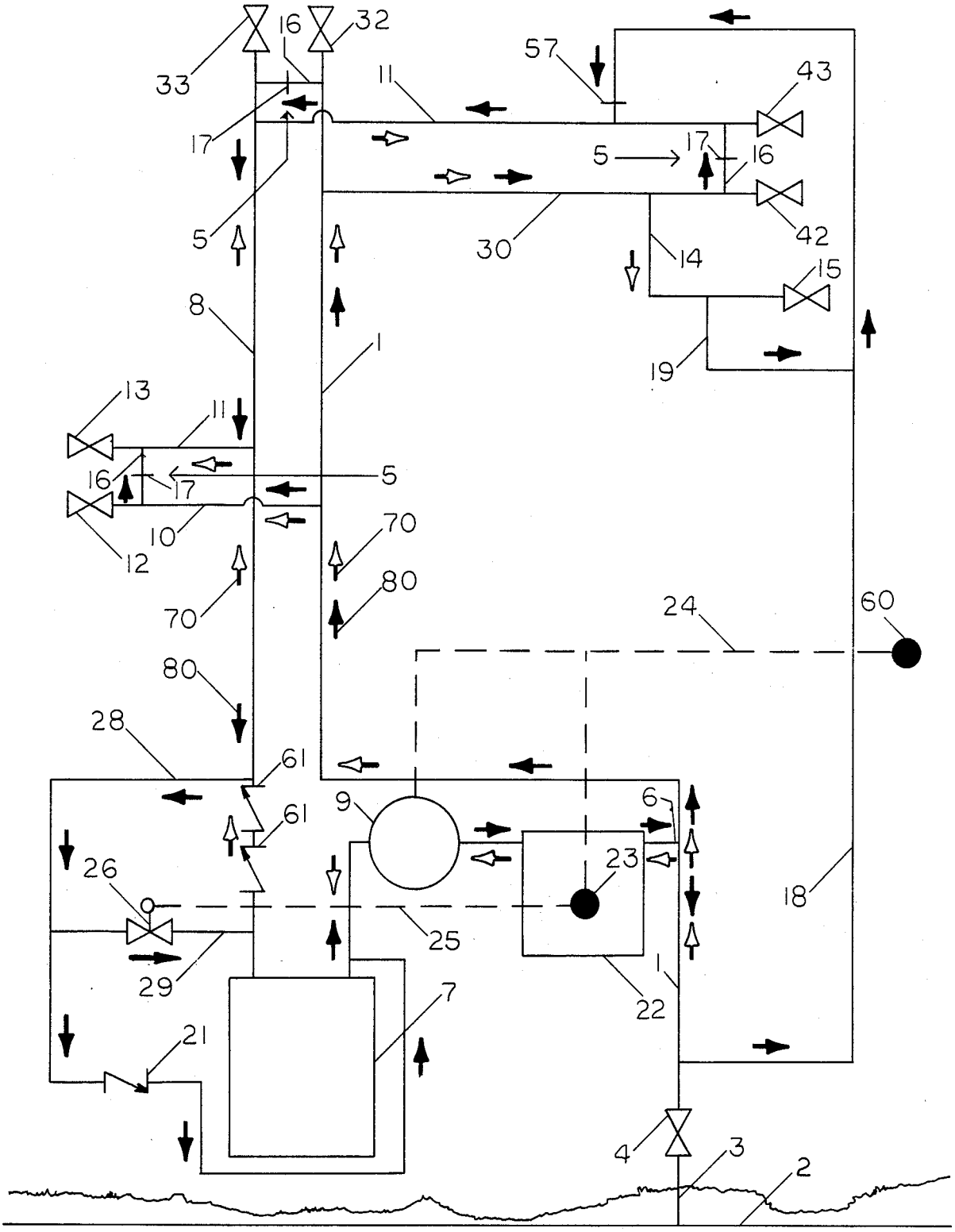
FIG. 2 is a diagrammatic illustration of a preferred embodiment of the freeze protection system of this invention.

In order to prevent noticeable overheating of cold water lines during lengthy pump operation and to reduce the heating load on hot water heater 7, the embodiment shown in FIG. 2 is preferred. A closed mixing tank 22 is provided, connected in-line in hot water tank inlet line 6 between cold water supply line 1 and hot water tank 7. Pump 9 is positioned between hot water tank 7 and mixing tank 22 so as to operate to pump toward the mixing tank 22. At least one check valve 61 (two shown for redundancy) is provided (preferably near hot water tank 7) to prevent backflow through hot water supply line 8 into hot water tank 7. Arrows in check valves 61,21 indicate the direction of permitted flow. A by-pass line 28 connects at one end to hot water supply line 8 on the opposite side of check valves 61 from hot water tank 7. By-pass line 28 connects at its other end to the hot water tank inlet line 6 between the hot water tank 7 and the mixing tank 22. A shunt line 29 has one end connected to by-pass line 28 and the other end connected to hot water tank 7 either directly or via hot water supply line 8 as shown. A check valve 21 is positioned in-line in the by-pass line 28 between shunt line 29 and hot water tank inlet line 6 so as to prohibit flow toward shunt line 29. A remote valve 26 (preferably a solenoid valve) is positioned in-line in shunt line 29. A first thermostat 23 is positioned in mixing tank 22 and is operatively connected by circuitry 25 to remote valve 26 so as to open remote valve 26 when the temperature in the mixing tank 22 reaches a desired low level and to close remote valve 26 when the temperature in the mixing tank 22 reaches a desired high level. A second thermostat 60 (similar to thermostat 20 in FIG. 1) is operatively connected by circuitry 24 to pump 9 and first thermostat 23 so as to activate pump 9 and energize first thermostat 23 when the ambient temperature around second thermostat 60 reaches a desired low level.

Thus, when the outside temperature reaches a critical low level, second thermostat 60 causes pump 9 to begin to circulate water from lines containing cold water (lines 6,1,10,30 and 14) through restrictive connections 5,50 and into lines containing hot water (lines 8,11 and 31), eventually circulating back through hot water supply line 8 into by-pass line 28, into hot water tank inlet line 6, and back to pump 9 (if remote valve 26 is closed). Second thermostat 60 also energizes first thermostat 23 which, in turn, opens remote valve 26 whenever the mixing tank temperature falls below a desired level (e.g. 50 degrees Fahrenheit), allowing water to flow through remote valve 26, through hot water tank 7, forcing hot water into hot water tank inlet line 6 and into mixing tank 22. When the mixing tank temperature reaches a desired high level (e.g. 70 deg. F.), first thermostat 23 closes remote valve 26, again by-passing hot water tank 7.

Flow arrows 70 indicate normal flow in the system with water flowing through all fixtures 12,13,32,33,42,43 and 15. Flow arrows 80 indicate circulating flow in the system with pump 9 in operation and remote valve 26 open. If a hot water fixture is opened during pump operation, pressure from the main water supply line 2 will overcome the flow through pump 9 allowing normal operation of hot water fixtures 13,33 and 43. Because of the small pressure differential across the pump 9 (usually around 5 psi), the system will operate according to near normal parameters whether pump 9 is operating or not. By circulating from cold water lines to hot water lines, the water returning to the cold water lines through mixing tank 22 is cooled to a point whereby the added heat is not noticeable.

Thus, a system for freeze protection of pipes is provided which combines the features of constant flow and heat application. Installation is relatively simple and low cost, and operation costs are very small. The system can be self-actuating or manually actuated, only operating during periods of critical cold weather. Normal operation of fixtures and pipes is not appreciably affected by the operation of the pump 9 or by restrictive connections 5,50. Of course, many other alternate embodiments of the invention will occur to those skilled in the art, and are intended to be included within the scope and spirit of the following claims.

I claim:

1. A system for freeze protection of pipes, comprising:

a. a cold water supply line, connected to a main water supply line at one end and to at least one cold water fixture at the other end;

b. a hot water tank having an inlet and an outlet;

c. a hot water tank inlet line, connected at one end to said cold water supply line, and at the other end to said hot water tank inlet;

d. a hot water supply line, connected to said hot water tank outlet at one end and to at least one hot water fixture at the other end;

e. at least one restrictive connection, connecting between said cold water supply line and said hot water supply line; and f. a circulating pump, connected in-line in a circuit comprising said cold water supply line, said hot water tank inlet line, said hot water tank, said hot water supply line and said restrictive connection, for continuously circulating water flow at a desired rate through said circuit to prevent freezing of water in said circuit.

2. A system for freeze protection of pipes according to claim 1, further comprising:

g. at least one cold water branch line, connected to said cold water supply line at one end and to a cold water fixture at the other end;

h. at least one hot water branch line, connected to said hot water supply line at one end and to a hot water fixture at the other end; and i. at least one said restrictive connection, connecting between one said cold water branch line or said cold water supply line and one said hot water branch line or said hot water supply line.

3. A system for freeze protection of pipes according to claim 1, further comprising:

g. a thermostat, connected to said circulating pump so as to activate said pump when the ambient temperature around said thermostat reaches a desired level.

4. A system for freeze protection of pipes according to claim 2, further comprising:

j. a thermostat, connected to said circulating pump so as to activate said pump when the ambient temperature around said thermostat reaches a desired level.

5. A system for freeze protection of pipes, comprising:

a. a cold water supply line, connected to a main water supply line at one end and to at least one cold water fixture at the other end;

b. a hot water tank having an inlet and an outlet;

c. a hot water tank inlet line, connected at one end to said cold water supply line, and at the other end to said hot water tank inlet;

d. a hot water supply line, connected to said hot water tank outlet at one end and to at least one hot water fixture at the other end;

e. at least one restrictive connection, connecting between said cold water supply line and said hot water supply line;

f. a mixing tank, connected in-line in said hot water tank inlet line;

g. a circulating pump, connected in-line in said hot water tank inlet line between said mixing tank and said hot water tank so as to pump toward said mixing tank;

h. a first check valve, connected in-line in said hot water supply line so as to prohibit flow in said hot water supply line through said first check valve toward said hot water tank;

i. a by-pass line, connected at one end to said hot water supply line at a point between said check valve and said other end of said hot water supply line, and at the other end to said hot water tank inlet line between said hot water tank and said pump;

j. a shunt line, connected at one end to said hot water tank, and at the other end to said by-pass line;

k. a remote valve, connected in-line in said hot water shunt line;

l. a second check valve, connected in-line in said by-pass line between said shunt line and said hot water tank inlet line so as to prohibit flow through said check valve toward said shunt line;

m. a first thermostat, positioned inside said mixing tank and connected to said remote valve so as to open said remote valve when the temperature of the water in said mixing tank reaches a desired low level and to close said remote valve when the temperature of the water in said mixing tank reaches a desired high level; and n. a second thermostat, connected to said circulating pump and said first thermostat so as to activate said pump and energize said first thermostat when the ambient temperature around said second thermostat reaches a desired level.

6. A system for freeze protection of pipes, comprising:

a. a cold water supply line, connected to a main water supply line at one end and to at least one cold water fixture at the other end;

b. a hot water tank having an inlet and an outlet;

c. a hot water tank inlet line, connected at one end to said cold water supply line, and at the other end to said hot water tank inlet;

d. a hot water supply line, connected to said hot water tank outlet at one end and to at least one hot water fixture at the other end;

e. at least one cold water branch line, connected to said cold water supply line at one end and to a cold water fixture at the other end;

f. at least one hot water branch line, connected to said hot water supply line at one end and to a hot water fixture at the other end;

g. at least one restrictive connection, connecting between one said cold water branch line or said cold water supply line and one said hot water branch line or hot water supply line;

h. a mixing tank, connected in-line in said hot water tank inlet line;

i. a circulating pump, connected in-line in said hot water tank inlet line between said mixing tank and said hot water tank so as to pump toward said mixing tank;

j. a first check valve, connected in-line in said hot water supply line so as to prohibit flow in said hot water supply line through said first check valve toward said hot water tank;

k. a by-pass line, connected at one end to said hot water supply line at a point between said check valve and said other end of said hot water supply line, and at the other end to said hot water tank inlet line between said hot water tank and said pump;

l. a shunt line, connected at one end to said said hot water tank, and at the other end to said by-pass line;

m. a remote valve, connected in-line in said hot water shunt line;

n. a second check valve, connected in-line in said by-pass line between said shunt line and said hot water tank inlet line so as to prohibit flow through said check valve toward said shunt line;

o. a first thermostat, positioned inside said mixing tank and connected to said remote valve so as to open said remote valve when the temperature of the water in said mixing tank reaches a desired low level and to close said remote valve when the temperature of the water in said mixing tank reaches a desired high level; and p. a second thermostat, connected to said circulating pump and said first thermostat so as to activate said pump and energize said first thermostat when the ambient temperature around said second thermostat reaches a desired level.

* * * * *